US007383919B2

(12) United States Patent
Arlasky

(10) Patent No.: US 7,383,919 B2
(45) Date of Patent: Jun. 10, 2008

(54) ROTATABLE PROPELLER DRIVEN ENGINE EXHAUST SYSTEM

(75) Inventor: David F. Arlasky, Huntington Beach, CA (US)

(73) Assignee: Arlasky Performance Inc., Irvine, CA (US)

( * ) Notice: Subject to any disclaimer, the term of this patent is extended or adjusted under 35 U.S.C. 154(b) by 0 days.

(21) Appl. No.: 10/623,960

(22) Filed: Jul. 17, 2003

(65) Prior Publication Data

US 2005/0011697 A1 Jan. 20, 2005

(51) Int. Cl.

| | |
|---|---|
| ***F01N 1/10*** | (2006.01) |
| ***F01N 1/12*** | (2006.01) |
| ***F01N 1/16*** | (2006.01) |
| *F01N 1/02* | (2006.01) |
| *F01N 1/04* | (2006.01) |

(52) U.S. Cl. ..... 181/249; 181/225; 181/252; 181/255; 181/256; 181/278; 181/279

(58) Field of Classification Search ..... 181/225, 181/226, 247–249, 222, 252, 256, 262, 263, 181/269, 277–279

See application file for complete search history.

(56) References Cited

U.S. PATENT DOCUMENTS

| | | | | | |
|---|---|---|---|---|---|
| 832,124 | A | * | 10/1906 | Farmer | 181/277 |
| 867,973 | A | * | 10/1907 | Hoover | 181/277 |
| 1,229,471 | A | * | 6/1917 | Jones et al. | 181/264 |
| 1,286,365 | A | * | 12/1918 | Loomis | 181/225 |
| 1,473,235 | A | * | 11/1923 | Jones | 181/277 |
| 1,685,006 | A | * | 9/1928 | Schultz | 181/262 |
| 1,816,245 | A | | 7/1931 | Wolford | |
| 1,818,469 | A | * | 8/1931 | Floyd, Jr. | 181/254 |
| 2,076,827 | A | * | 4/1937 | Ross | 181/277 |
| 2,646,854 | A | | 7/1953 | Walker | |
| 3,000,465 | A | * | 9/1961 | Bruno | 181/277 |
| 3,016,692 | A | * | 1/1962 | Lapella et al. | 417/171 |
| 3,017,948 | A | * | 1/1962 | Shepherd | 181/277 |
| 3,182,748 | A | | 5/1965 | Wirt | |
| 4,050,539 | A | * | 9/1977 | Kashiwara et al. | 181/280 |
| 4,109,753 | A | * | 8/1978 | Lyman | 181/252 |
| 4,129,196 | A | * | 12/1978 | Everett | 181/280 |
| 4,222,456 | A | * | 9/1980 | Kasper | 181/296 |
| 4,263,981 | A | * | 4/1981 | Weiss et al. | 181/252 |
| 4,263,982 | A | * | 4/1981 | Feuling | 181/256 |
| 4,303,143 | A | * | 12/1981 | Taniguchi | 181/263 |
| 4,317,502 | A | * | 3/1982 | Harris et al. | 181/280 |
| 4,331,213 | A | * | 5/1982 | Taniguchi | 181/263 |

(Continued)

FOREIGN PATENT DOCUMENTS

GB 2224540 A * 5/1990

(Continued)

*Primary Examiner*—Edgardo San Martin
(74) *Attorney, Agent, or Firm*—Martin Faier; James M. Faier; Faier & Faier PC

(57) ABSTRACT

An exhaust chamber system having a rotatable propeller type blade assembly at the entry to an expansion chamber which creates a vortex that swirls exhaust gas towards the outlet. The resultant action within the exhaust chamber aids in scavenging internal combustion engine exhaust gases, and in reducing system back pressure. The exhaust chamber maintains the sound level of the exhaust within acceptable limits while delivering improved horsepower, torque, and/or fuel efficiency over other known conventional mufflers.

9 Claims, 2 Drawing Sheets

U.S. PATENT DOCUMENTS

| | | | | | |
|---|---|---|---|---|---|
| 4,339,918 | A | * | 7/1982 | Michikawa | 60/316 |
| 4,533,015 | A | * | 8/1985 | Kojima | 181/280 |
| 5,676,468 | A | * | 10/1997 | Webb | 384/208 |
| 5,872,342 | A | * | 2/1999 | Gysling | 181/277 |
| 5,962,822 | A | | 10/1999 | May | |
| 6,343,673 | B1 | * | 2/2002 | Chang | 181/227 |
| 6,796,296 | B2 | | 9/2004 | Kim | |
| 2004/0046391 | A1 | | 3/2004 | Vasudeva | |
| 2004/0050618 | A1 | | 3/2004 | Marocco | |
| 2005/0011697 | A1 | | 1/2005 | Arlasky | |
| 2005/0045418 | A1 | | 3/2005 | Choi | |

FOREIGN PATENT DOCUMENTS

| | | | | |
|---|---|---|---|---|
| JP | 56032023 | A | * | 4/1981 |
| JP | 04081507 | A | * | 3/1992 |

* cited by examiner

ROTATABLE PROPELLER DRIVEN ENGINE EXHAUST SYSTEM

FIELD OF THE INVENTION

The present invention provides a muffler for internal combustion engines which delivers improved horsepower and/or fuel efficiency over standard mufflers.

BACKGROUND

Due to environmental concerns, governmental entities have steadily imposed stricter limits on the amount and type of exhaust emitted by vehicles powered by the internal combustion engine. Moreover, the amount of noise produced by such engines must also meet stringent standards. While such limits may improve air quality and decrease noise pollution, such limits also produce severe drawbacks in increased fuel consumption and decreased power production by the affected engines. It is believed that such drawbacks are a result of back pressure of exhaust gas created by the very equipment that muffles the noise and cleans the exhaust gas. Accordingly, it is believed that such drawbacks can be mitigated by equipment that will increase exhaust flow-through.

Various systems have been proposed to provide a more efficient means of reducing noise and/or air pollution from internal combustion engine exhaust. Some such proposed systems are found in U.S. Pat. No. 4,533,015 to Kojima; U.S. Pat. No. 4,339,918 to Michikawa; U.S. Pat. No. 4,331,213 to Taniguchi; U.S. Pat. No. 4,317,502 to Harris et al.; U.S. Pat. No. 4,303,143 to Taniguchi; U.S. Pat. No. 4,222,456 to Kasper; U.S. Pat. No. 4,129,196 to Everett; U.S. Pat. No. 4,109,753 to Lyman; U.S. Pat. No. 4,050,539 to Kashiwara et al.; and U.S. Pat. No. 3,016,692 to Iapella et al. However, the quest to decrease noise and exhaust emissions, while off-setting the concomitant decreases in fuel efficiency and power production, proves to be an ongoing struggle.

SUMMARY OF THE INVENTION

The present invention provides a muffler comprising a rotatable propeller within or adjacent to an expansion chamber to swirl exhaust gas towards the outlet. The muffler maintains the sound level of the exhaust within acceptable limits, while delivering improved power and/or fuel efficiency over that of standard mufflers.

DETAILED DESCRIPTION

The invention is described by the following examples. It should be recognized that variations based on the inventive features disclosed herein are within the skill of the ordinary artisan, and that the scope of the invention should not be limited by the examples. To properly determine the scope of the invention, an interested party should consider the claims herein, and any equivalent thereof. In addition, all citations herein are incorporated by reference.

Figure 1:
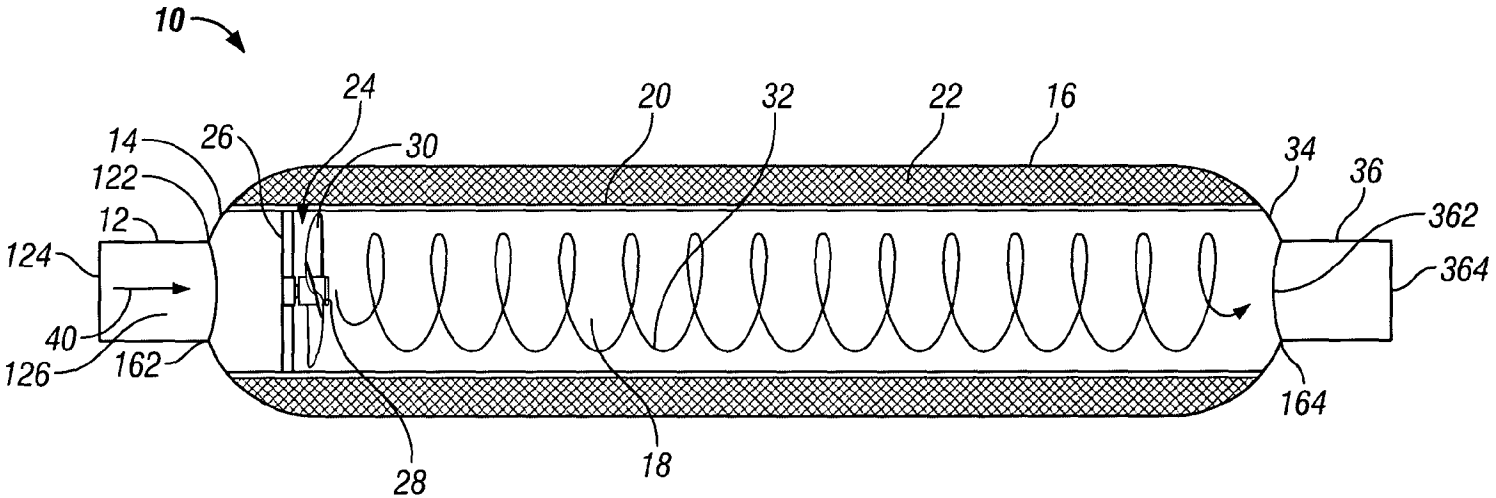
FIG. 1 is a longitudinal cross-sectional view of an embodiment of a muffler according to the invention.

FIG. 1 illustrates a cross-sectional view along the longitudinal axis of an embodiment of a muffler 10 according to the invention. Muffler 10 comprises an outer shell 16 having an inlet 162 at a tapered entry end 14 and an outlet 164 at tapered exit end 34. In other embodiments, the outer shell has a substantially flat inlet end and/or outlet end. Materials used to form mufflers are well-known in the art. In an embodiment, the muffler casing and the relevant tubes are made from metals such as stainless steel. Methods of attaching the various components are also well-known. For example, coupling points can be formed integrally, or welded or brazed. Additional embodiments include mufflers having an oval cross-section having a round expansion area adjacent the propeller. The round expansion area may continue throughout the expansion chamber, or can elongate about an axis to conform with the outer oval cross-section.

An inlet tube 12 is attached at a proximal end 122 to shell 16 at inlet 162. A distal end 124 of inlet tube 12 is attached directly or indirectly to an exhaust gas source, such as an internal combustion engine (not shown). The interior 126 of inlet tube 12 opens up into an expansion chamber 18 defined by the interior of an expansion chamber tube 20. The expansion chamber tube 20 is attached substantially coaxially to outer shell 16. Although shown as attached to the outer shell so that a portion of the outer shell defines expansion chamber, expansion chamber tube 20 can be tapered at its ends, such that its opposing openings may also define inlet 162 and outlet 164. Moreover, expansion chamber tube 20 is attached to outer shell 16 such that the exterior of the expansion chamber tube 20 and the interior of the outer shell 16 combine to define a sound suppression sleeve 22 that surrounds the expansion chamber 18.

Sound suppression sleeve 22 is packed with known sound suppression materials. Examples of such materials include fiberglass, glass wool, copper wool, copper strands, steel wool, etc. In an embodiment the sound suppression material is fiberglass. Tube 20 is perforated with apertures (not shown) so that the expansion chamber 18 is in communication with the materials in the sound suppression sleeve 22. In an embodiment, tube 20 has about a 50% porosity. In another embodiment, tube 20 has between about 40 to about 80% porosity. In another embodiment, expansion chamber 18 has at least about 85% greater flow cross-sectional area than inlet tube 12. In a further embodiment, expansion chamber 18 has at least about 75% greater flow cross-sectional area than inlet tube 12. In yet another embodiment, expansion chamber 18 has between about 75% to about 90% greater flow cross-sectional area than inlet tube 12.

Figure 3:
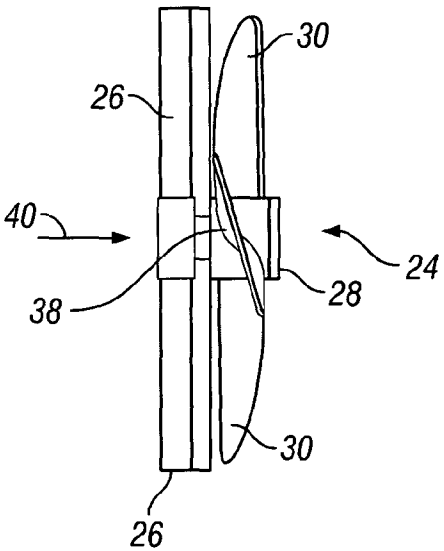
FIG. 3 is side close-up view of the propeller of an embodiment of a muffler according to the invention.
Figure 4:
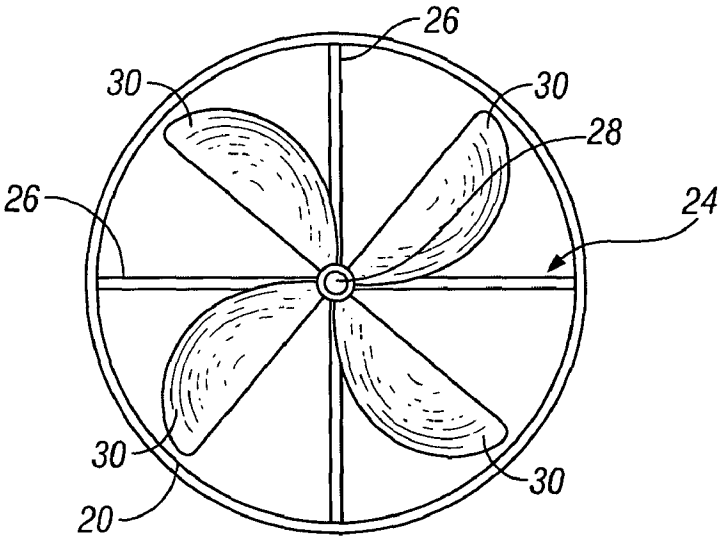
FIG. 4 is an end close-up view of the propeller of an embodiment a muffler according to the invention.

In an embodiment, within expansion chamber 18, at an end proximal to inlet tube 12, a propeller 24 (see FIGS. 1, 3 and 4) is attached to the muffler by an rotational axis mount 28 to propeller support 26. In an embodiment, the propeller comprises four blades 30, each having about an 30 degree spiral twist 38. Mount 28 securely attaches propeller 24 to propeller support 26, but provides enough play for the propeller to rotate freely, as exhaust gas is forced out of inlet tube 12 into expansion chamber 18. Alternatively, the blades have a turn of between about 20-60 degrees. There is no difference in performance if the blades are rotated clockwise or counterclockwise, as long as all blades are consistent with each other. In other embodiments, the propeller can have 2 to 8 blades. In another embodiment the propeller has 3 to 5 blades. In a preferred embodiment, the blades are relatively narrow. However, various blade widths may be utilized in the context of the invention.

Figure 2:
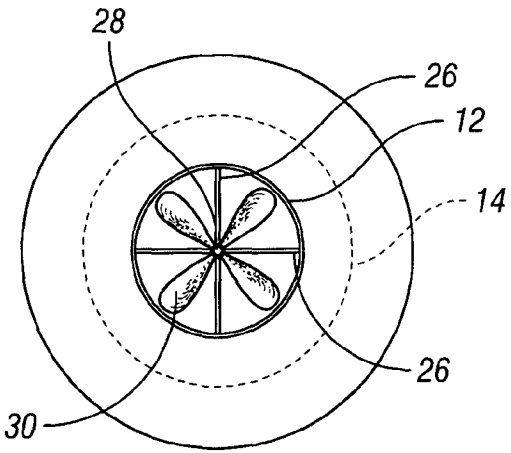
FIG. 2 is an end view of an embodiment of a muffler according to the invention.

Various methods of mounting the propeller on the supports are known. In an embodiment, the propellers are mounted on a teflon-filled bronze bearing, which is, in turn, mounted on a standard shoulder screw, attached to the propeller support. In another embodiment, the propellers are mounted on a shoulder screw, which is mounted in a teflon-filled bronze bearing that is attached to the propeller support. The bearings and screws are also made of stainless steel or alloy steel. As shown in FIG. 1, propeller 24 can be fitted in front of support 26. As shown in FIG. 2, the propeller (represented by blades 30) can also be fitted in back of support 26.

In FIG. 1, an arrow 40 in the interior 126 of inlet tube 12 represents gas traveling in a substantially linear direction in that area. When the gas reaches propeller 24, the gas forces the propeller 24 to spin, which, in turn, causes the gas to spin (shown as arrow 32) as it passes through the expansion chamber 18. The swirling effect forces the exhaust towards the tapered exit end 34 which maintains the spin-flow of the gasses to propel the gas out of the muffler through outlet tube 36. The outlet tube 36 is attached at a proximal end 362 to outlet 164 and leads to the atmosphere at distal end 364, either directly or indirectly (e.g. via a tailpipe). In an embodiment, outlet tube 36 has substantially the same interior diameter as inlet tube 12. In another embodiment, the inlet tube 12 has a substantially smaller interior diameter than outlet tube 36.

Figure 5:
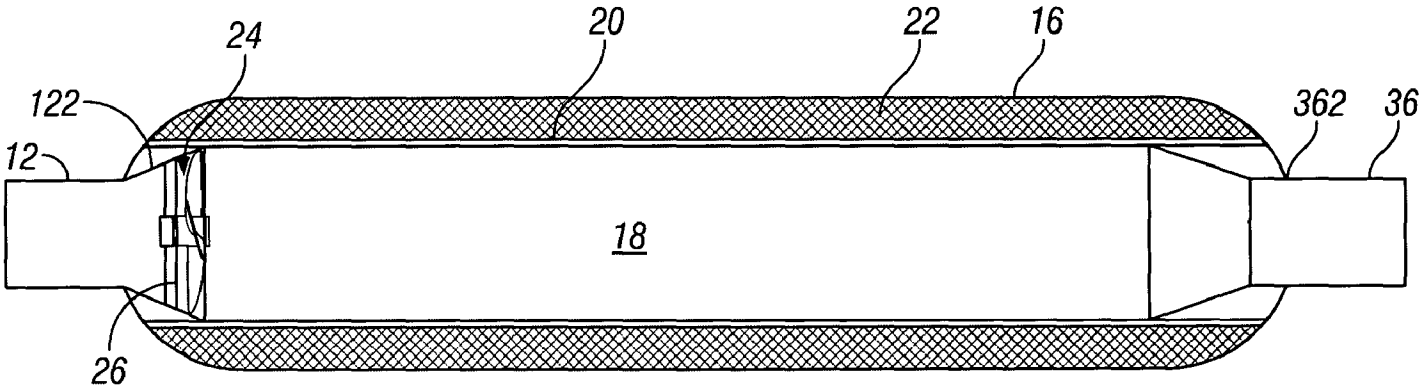
FIG. 5 illustrates another embodiment of a muffler according to the invention.

In an alternative embodiment, propeller 24 is supported within the proximal end 122 of the inlet tube 12 (FIG. 5). Note that in this embodiment, the proximal ends of inlet tube 12 and outlet tube 36 are shown as protruding into expansion chamber 18. Different means to attach the inlet and outlet tubes are known, as are different means to attach the propeller to the muffler. Without being limited by any theory, it is believed that the propeller forces the exhaust to spin from a low volume space to a higher volume space, thereby improving throughput of the exhaust.

As shown in the drawings, with particular reference to FIGS. 1-2, and 5, the diameter of the chamber 18 should be no more than about 2.2 times the diameter of the inlet pipe 12, and the overall diameter of the interior of shell 16 should be about two times the diameter of the inlet pipe 12, so that the spun gasses 32, as indicated n FIG. 1 by the arrow, traveling through the chamber 18 exit in a swirling action at an accelerating rate when directed by the blades 30, angularly disposed toward the outlet 36. Also, as shown, the ratio of the length of the flow barrel or chamber 18 to the area of the inlet pipe 12 should be about 0.08. For example, if the area of the inlet pipe 12 is about 6.47 sq. inches, and the area of the flow barrel or chamber 18 is about 12.568 inches, the equation 12.568/6.47 results and will yield a ration of 1.9425, and when divided by the chamber length, for example, 24", the equation 1.9425/24 result, so the flow length ratio will be about 0.08. Also, as shown, the combined diameters of the inlet pipe 12 and the chamber 18 should not exceed about one-third the length of said chamber. As stated previously and shown, the blades 30 are preferably disposed at about a 30 degree spiral twist to direct combustion gases in a swirl-like path through said chamber toward said outlet pipe 36.

It is found that the exemplary embodiments of the invention provide high performance propulsion mufflers that increase horsepower and/or fuel efficiency for internal combustion engines, while maintaining the sound level of the engine within acceptable levels. Without being limited by any particular theory, it is believed that as the exhaust gas enter the muffler, the propeller forces the gas to rotate into a tightly spun vortex, as the gas expands in the expansion chamber. This facilitates the flow of the gasses through the expansion chamber, and through the outlet tube. This effect creates a vacuum, which draws more gasses from the exhaust source, increasing the exhaust throughput of the engine.

Relative to similar standard mufflers that do not have the propeller, it has been found that the horsepower of the engine can be increased by up to about 19%. In an embodiment, the horsepower was improved to between about 13 and about 19%. In another embodiment the fuel milage was increased by up to about 12% in city driving, and up to about 15% in highway driving. In a further embodiment, the fuel efficiency was improved to between about 5 to about 12% in the city. In yet another embodiment, the fuel efficiency was improved to between about 6 and about 15% on the highway. Vehicles that may benefit from such a muffler include trucks, automobiles, lawn mowers, boats, snowmobiles, power machinery, or other equipment driven by the internal combustion engine.

I claim:

1. A high performance exhaust system for removing combustion gases from an internal combustion engine comprising:

a shell;

a tubular chamber within said shell;

a sleeve in said shell;

sound suppression materials in said sleeve;

said tubular chamber having a substantially constant interior diameter and being perforated with apertures to about 40-80% porosity;

an inlet tube subassembly fastened at its one end to one end of said shell in communication with said tubular chamber;

an outlet in said chamber remote from said inlet tube for permitting combustion gases to exit said system;

a single rotatable propeller type blade assembly in said inlet tube having its blades arranged substantially inclined in a spiral twist relative to the path of said exhaust combustion gases, said rotatable propeller assembly being seated in but not blocking said chamber and capable of rotation when said combustion gases pass from said inlet tube into said tubular chamber, rotation of said propeller assembly inducing passage of exhaust gases through said expansion chamber to exit through said outlet, the length of said chamber being substantially greater than its diameter, said chamber having a flow cross section substantially 75% to 90% greater than the flow cross section of said inlet tube, so that gases entering said chamber are swirled into a tightly spun vortex thus creating a vacuum drawing gases through said chamber at an accelerating rate to exit said outlet.

2. The exhaust system according to claim 1, wherein said rotatable propeller type blade assembly is mounted on a Teflon-filled bronze bearing that is rotatably mounted on a shoulder screw.

3. The exhaust system according claim 1, wherein said rotatable propeller type blade assembly is comprised of multiple blades.

4. The exhaust system according to claim 3, wherein said blades of said rotatable propeller type blade assembly are arranged substantially at about a 30 degree spiral twist relative to the path of said exhaust combustion gases.

5. The exhaust system according to claim 1, wherein said sound suppression materials are selected from the group consisting of fiberglass, glass wool, copper wool, copper strands, steel wool and a combination thereof.

6. A device for increasing the efficiency of an internal combustion engine having an exhaust for gases wherein back pressure of exhaust gases exerted on said engine is reduced, said device comprising:

an inlet tube for exhaust gases in flow communication with said engine exhaust, a chamber having a substantially constant interior diameter for receiving exhaust gases in flow communication with said inlet tube, one end of said inlet tube being connected to one end of said chamber, an outlet tube at an end of said chamber remote from said inlet tube for exiting gases from said expansion chamber; and a single blade assembly having its blades arranged substantially inclined in a spiral twist relative to the path of said exhaust combustion gases and being adapted to move said exhaust gases into said chamber without blocking entry into said chamber;

wherein the length of said chamber is substantially greater than its diameter, said chamber having a flow cross section substantially 75% to 90% greater than the flow cross section of said inlet tube, so that gases entering said chamber are swirled into a tightly spun vortex thus creating a vacuum drawing gasses through said chamber at an accelerating rate to exit said outlet.

7. The device recited in claim 6, wherein said exhaust chamber system is joined directly to an internal combustion engine.

8. The device recited in claim 6, wherein said blade assembly is set between 20-60 degrees relative to the path of said exhaust gases.

9. A method for improving the performance of an internal combustion engine exhaust system by encouraging the flow of combustion gases to exit said engine comprising the steps:

providing an inlet attached to an engine and at one end of said inlet to one end of a chamber having a substantially constant interior diameter attached to said inlet, the length of said chamber being substantially greater than its diameter, said chamber having a flow cross section substantially 75% to 90% greater than the flow cross section of said inlet, and an outlet from said chamber remote from said inlet, attaching at said inlet one end a single rotatable propeller having a blade assembly arranged angularly disposed in a spiral twist relative to the path of said exiting gases toward said chamber within said exhaust system without materially blocking the flow of exhaust gases from said engine;

rotating said propeller when exhaust gases pass from said inlet into said chamber, and swirling exhaust gases entering said chamber responsive to rotating said propeller into a tightly spun vortex thus creating a vacuum drawing gasses through said chamber at an accelerating rate to exit its outlet without materially inducing back pressure on said engine.

* * * * *